United States Patent [19]

Deutsch

[11] 4,331,058

[45] May 25, 1982

[54] ADAPTIVE ACCOMPANIMENT LEVEL IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 209,775

[22] Filed: Nov. 24, 1980

[51] Int. Cl.[3] ..... G10H 1/02

[52] U.S. Cl. ..... 84/1.21; 84/1.27; 84/1.17

[58] Field of Search ..... 84/1.01, 1.21, 1.27, 84/1.17, 1.24

[56] References Cited

U.S. PATENT DOCUMENTS 4,144,789 3/1979 Deutsch ..... 84/1.27

4,214,503 7/1980 Deutsch ..... 84/1.27

*Primary Examiner*—J. V. Truhe

*Assistant Examiner*—Forester W. Isen

*Attorney, Agent, or Firm*—Ralph Deutsch

[57] ABSTRACT

A keyboard operated electronic musical instrument having a number of keyboards in which the loudness balance of the accompaniment keyboards are adaptively maintained at a preselected loudness ratio with respect to the solo keyboard. The loudness balance is automatically maintained as the tone switches are altered and as the number of actuated notes varies on the keyboards. The balance ratio is accomplished by adaptively scaling the harmonic coefficients used in a discrete Fourier transform to generate the tones for the accompaniment keyboards.

11 Claims, 5 Drawing Figures

ADAPTIVE ACCOMPANIMENT LEVEL IN AN ELECTRONIC MUSICAL INSTRUMENT

BACKGROUND OF THE INVENTION

1. Field of the Invention

This invention relates to electronic musical instruments and in particular is concerned with provision for automatically adjusting the level of the accompaniment to follow the dynamics of a solo keyboard.

2. Description of the Prior Art

An all too familiar word to an orchestral musician is the word "balance." It is one of the major tasks of the conductor to maintain a constantly changing balance between the loudness of those instruments having the most important musical passages and those instruments providing the background or accompaniment tones. The ability to balance various simultaneous musical lines is one of the primary attributes of the conventional acoustic piano. A skilled pianist has the capability of playing any desired notes in a balanced loudness relation with respect to the other notes.

Electronic keyboard actuated musical instruments, of the type given the generic name of "organ" suffer from the same type of musical balance problems experienced with conventional wind-blown organs. The balance problem is caused by the action by which a stop is either full "off" or full "on." Each stop controls a tone selection for the organ. Each stop not only changes the tone variety or tone color but in general the loudness of each stop is usually designed to be independent of the loudness of the other stops. If the stops for the solo keyboard are changed it frequently results in an accompaniment on the other keyboard or the pedal board which is either too loud or too soft with respect to the solo voices. The player usually has three options of means to correct the balance between the solo and accompaniment voices. He can change the accompaniment stops when the solo stops are changed and thereby attempt to reach a compromise in the desired solo tone color and the loudness and tone color of the accompaniment. Such a technique, although frequently used, requires considerable skill on the part of the musician. To be even moderately successful in obtaining a loudness balance, he must be very familiar with the available tones and their relative loudness for a number of combination stops. A second balance option is to use electronic controls which independently vary the loudness of each keyboard. While such controls seem to provide a good solution to the problem of balance, in practice it requires that each change in the stops for any keyboard dictates that changes must be made to the loudness controls of the other keyboards. Such an ideal balance technique is usually beyond the capability of all but the most skillful musicians. Even when independent loudness controls are available in an organ, all except the best players tend to ignore the balance of musical lines and simply change the tone colors with the stops and "live" with the resultant relative loudness of the keyboards. It is such subtle differences in balance that distinguish a mediocre performance from a good performance in which by careful attention to tonal and loudness balance the musician sets the mood of the musical passages.

Various electronic organs have been designed in which the stops can be used to select a tone color and at the same time control the loudness of the tone. The most familiar of such systems is the one using a set of drawbars each of which selects the loudness of a harmonic associated with an actuated keyboard switch. A system of this type is discussed in U.S. Pat. No. 3,636,231 entitled "DC Keyed Synthesis Organ Employing An Integrated Circuit." With this arrangement it is possible to control the tone color by the setting of nine controls. After a tone color is selected, the loudness can be changed by moving all the drawbars simultaneously. The loudness change is not easy to accomplish without changing the tone color and in practice the drawbars are only used to vary the tone color.

A system for using a single stop to control both the selected tone and its relative loudness is described in U.S. Pat. No. 3,823,390 entitled "Musical Tone Wave Shape Generating Apparatus." In theory the stop control system described in the patent can be used to adjust the loudness of each selected tone color. In practice one finds that it is impossible to maintain a balance during a performance because the player does not have sufficient time to selectively set the level of each stop control. The musician usually actuates these stops to their full on or full off position so that the property of individual stop loudness controls is completely wasted.

It is an object of this invention to provide means for automatically maintaining a selected loudness balance between keyboards.

It is a further object of this invention to maintain a selected balance which is adaptive to the number of notes actuated on each of the keyboards.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a master data set is created by implementing a discrete Fourier algorithm using a stored set of harmonic coefficients which characterize a preselected musical tone. The computations are carried out at a fast rate which may be nonsynchronous with any musical frequency. Preferably the harmonic coefficients and the orthogonal functions required by the Fourier algorithm are stored in digital form and the computations are carried out digitally. At the end of a computational cycle the master data set is stored in a main register.

Following a computation cycle, a transfer cycle is initiated during which the master data set is transferred to preselected members of a multiplicity of note registers. Tone generation continues uninterrupted during the computation and transfer cycles.

The present invention is directed to an improved arrangement by which a selected loudness balance between keyboards is maintained and is independent of the stops actuated for the various organ keyboards.

A level control signal is used to select a constant which represents the desired loudness balance between the solo keyboard and an accompaniment keyboard. During the computation cycle, a loudness number is computed in response to all the stops actuated for the solo keyboard. The harmonic coefficients selected by the accompaniment keyboard actuated stops are scaled by the loudness number thereby maintaining the preselected loudness balance. A means is provided for maintaining a preselected loudness balance as the number of notes are varied on both the solo and accompaniment keyboards.

BRIEF DESCRIPTION OF THE DRAWINGS

For a better understanding of the invention reference should be made to the accompanying drawings.

DETAILED DESCRIPTION OF THE INVENTION

The present invention is directed to an improvement in the tone generation system of the type that computes the consecutive points of a musical waveshape by implementing a discrete Fourier transform using selected sets of harmonic coefficients. A tone generation system of this type is described in detail in U.S. Pat. No. 4,085,644 entitled "Polyphonic Tone Synthesizer" and which is hereby incorporated by reference. In the following description, all elements of the system which have been described in the referenced patent are identified by two digit numbers which correspond to the same numbered elements used in the patent. All system element blocks which are identified by three digit numbers correspond to elements added to the Polyphonic Tone Synthesizer to implement the improvements of the present invention.

Figure 1:
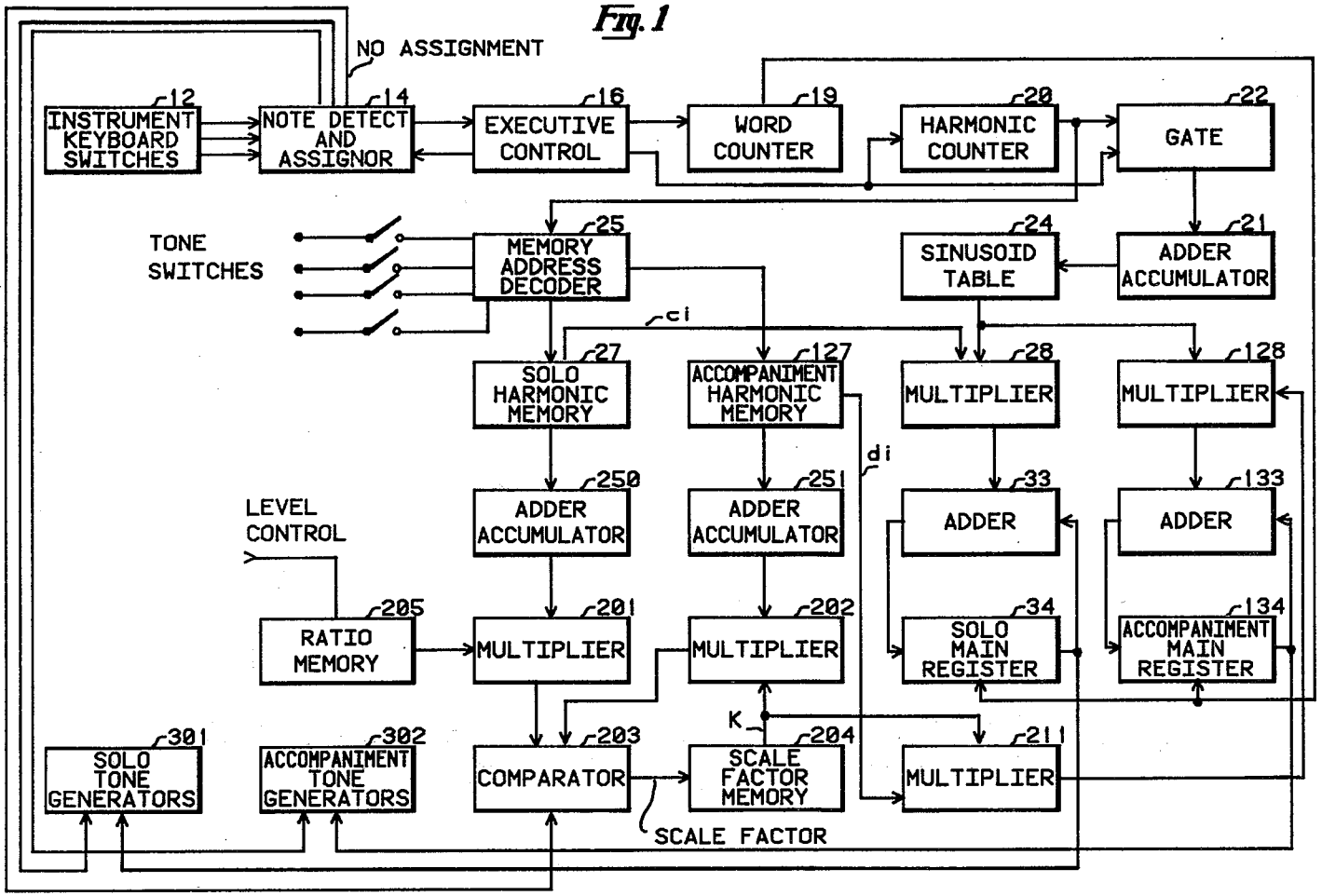
FIG. 1 is a schematic block diagram of an embodiment of the present invention.

Two sets of tone generators are shown in FIG. 1. One set is assigned to keyboard switches actuated on the solo keyboard and the second set is assigned to keyboard switches actuated on the accompaniment keyboard. The usual arrangement is to use the upper keyboard for the solo keyboard and to use the lower keyboard as the accompaniment keyboard.

The collection of keyswitches for all keyboards is shown generally by the block labeled instrument keyboard switches 12. Whenever a keyswitch is actuated or released on any of the keyboards, note detect and assignor 14 detects such actuations and releases, and stores information corresponding to the note within an octave, the octave number for the keyboard, and a keyboard identification number in a memory (not shown). This memory is a component of the note detect and assignor 14. The operation of a suitable note detect and assignor subsystem is described in U.S. Pat. No. 4,022,098 entitled "Keyboard Switch Detect and Assignor" which is hereby incorporated by reference.

A computation cycle is initiated by the executive control 16. The computation cycle can be initiated when one or more keys have been actuated on any of the keyboards. The start of a computation cycle is inhibited until the completion of a transfer cycle so that tone generation can continue uninterrupted during the repetitive sequences of computation cycle and transfer cycle.

At the start of a computation cycle, executive control 16 resets the contents of the word counter 19 and the harmonic counter 20 to an initial state. The word counter 19 is implemented to count modulo 64 corresponding to the number of equally spaced points for one period of a musical waveshape. The word counter 19 is incremented by signals furnished by the executive control 16. The count states of this counter are used to address data into and out of the solo main register 34 and the accompaniment main register 134.

The harmonic counter 20 is incremented each time that the word counter 19 returns to its initial count state. The harmonic counter 20 is implemented to count modulo 32. The general rule is that the maximum number of harmonics is no greater than one-half of the number of equally spaced points defining one period of the musical waveshape.

Gate 22, in response to a signal from the executive control 16, transfers the current state of the harmonic counter to the adder-accumulator 21 which adds the transferred data to the current data in its accumulator.

The contents of the adder-accumulator 21 are called argument values and are used to address stored trigonometric function values from the sinusoid table 24.

The trigonometric function data values addressed out from the sinusoid table 24 are furnished as one input to both the multiplier 28 and the multiplier 128. It is at this point that the system shown in FIG. 1 divides into two tone generating channels. A master data set for the solo tone generators is computed and stored in the solo main register 34. A master data set for the accompaniment tone generators is computed simultaneously and stored in the accompaniment main register 134.

The harmonic coefficients used to generate the solo master data set are stored in the solo harmonic memory 27 while the harmonic coefficients used to generate the accompaniment master data set are stored in the accompaniment harmonic memory 127. A set of harmonic coefficients is stored corresponding to each of a number of stop switches. The stop switches are also called tone switches. These switches select the harmonic coefficient which are addressed out by means of the memory address 25 in response to the count states of the harmonic countr 20.

With each stored set of harmonic coefficients, there is also stored an associated loudness value. This loudness value corresponds to a preselected loudness chosen for a tone generated from the associated set of harmonic coefficients. The loudness value can be computed as the sum of the squared magnitude of each of a corresponding set of harmonic coefficients. This sum is usually multiplied by a selected constant multiplier to provide numeric scaling for the various computational elements of FIG. 1. The loudness value $p_{si}$ for the solo manual can be calculated from the relation $$P_{si} = K' \sum_{q=1}^{32} c_{iq}^2 \qquad \text{Eq. 1}$$

where i denotes the $i^{th}$ stop in the set of stop switches and the numbers $c_{iq}$ are the solo harmonic coefficients for the $i^{th}$ stop. K' is a preselected scale constant.

If the solo voice is generated from a combination of selected solo stops, then the combination loudness value is evaluated as the sum of the individual loudness values for each selected set of harmonic coefficients. Thus $$P_s = \sum_{i=1}^{M} P_{si} \qquad \text{Eq. 2}$$

where M denotes the number of actuated stop switches.

In an analogous fashion if the accompaniment voice is generated from a combination of selected accompaniment stops, then the combination loudness value is evaluated as the sum of the individual loudness values for each selected set of accompaniment voice harmonic coefficients. Thus $$P_a = \sum_{i=1}^{L} P_{ai} \quad \text{Eq. 3}$$

where L denotes the number of actuated accompaniment stop switches and the loudness values $p_{ai}$ for the selected accompaniment voices are calculated from the relation $$P_{ai} = K' \sum_{q=1}^{32} d_{iq}^2 \quad \text{Eq. 4}$$

i denotes the $i^{th}$ stop in the set of selected accompaniment stops and $d_{iq}$ are the accompaniment harmonic coefficients stored for the $i^{th}$ stop.

Adder-accumulator 250 adds and accumulates the sum $P_s$ for the individual loudness values $P_{si}$ addressed out from the memory containing the solo harmonic coefficient 27. Similarly adder-accumulator 251 adds and accumulates the sum $P_a$ for the individual loudness values $P_{ai}$ addressed out from the memory containing the accompaniment harmonic coefficients 127.

A loudness balance ratio number R is accessed from a stored set of numbers stored in the ratio memory 205 in response to a level control signal. The level control signal can be selected by means of an instrument console control operated by the musician. R is a numeric value which represents a selectable desired balance between the solo voices (upper keyboard) and the accompaniment voices (lower keyboard). Thus R is a numeric value representing a selected ratio of the two loudness values.

The value of $P_s$ contained in the adder-accumulator 250 is multiplied in multiplier 201 with the value of the constant R addressed out from the ratio memory 205.

The scale factor memory 204 is an addressable memory which is used to store a set of scale factors. These scale factors are denoted by the letter K. The particular address, or value of K, accessed from the scale factor memory 204 is determined by a signal provided by the comparator 203.

The loudness value $P_a$ contained in the adder-accumulator 251 is multiplied by the value of K accessed from the scale factor memory 204 by means of the multiplier 202 to form the product value $KP_a$.

The product value $KP_a$ is compared with the scaled loudness value $RP_s$ by means of the comparator 203. If the product value $KP_a$ is not within some preselected difference from the value $RP_s$, the difference value is furnished as an address data signal to address a new value of K from the scale factor memory 204. The values of K stored in the scale factor memory 204 are stored in address locations such that if $KP_a$ is less than $RP_s$, a larger value will be addressed out from the scale factor memory 204. If $KP_a$ is larger than $RP_s$, a smaller value of K will be addressed out from the scale factor memory 204. If $KP_a$ is equal to $RP_s$ or differs from it by less than the above mentioned preselected difference value, the present value of K is left unchanged.

The purpose of leaving the value of k unchanged for small differences between $RP_s$ and $KP_a$ is to prevent the loudness compensation system from oscillating about the true balance point.

The value of the scale factor K addressed out from the scale factor memory K is used by the multiplier 211 to multiply, or scale, the accompaniment harmonic coefficients $d_i$ read out from the accompaniment harmonic memory 127. The resultant scaled harmonic coefficients are called scaled data sets.

It is noted that the adaptive keyboard balance system described above does not cause the solo voices to be generated at a preselected single loudness level. In fact, the solo voice level will vary in the usual, or normal, fashion as the combination of actuated solo stop switches are changed. For each combination of the solo stop switches, the accompaniment voice loudness will be automatically and adaptively adjusted to satisfy the loudness ratio R selected by means of the level control signal. It should also be noted that a change in the combination of the actuated stop switches for the accompaniment voices will produce the desired changes in the output accompaniment tone color and these voices will be automatically and adaptively adjusted in loudness level to maintain the balance in loudness with the solo voices as determined by the level control signal.

The master data set stored in the solo main register 34 is furnished to the solo tone generators 301 to produce output audible solo musical tones in the manner described in the referenced U.S. Pat. No. 4,085,644. In a similar manner, the master data set stored in the accompaniment main register 134 is furnished to the accompaniment tone generators 302 to produce output audible accompaniment musical tones.

Figure 2:
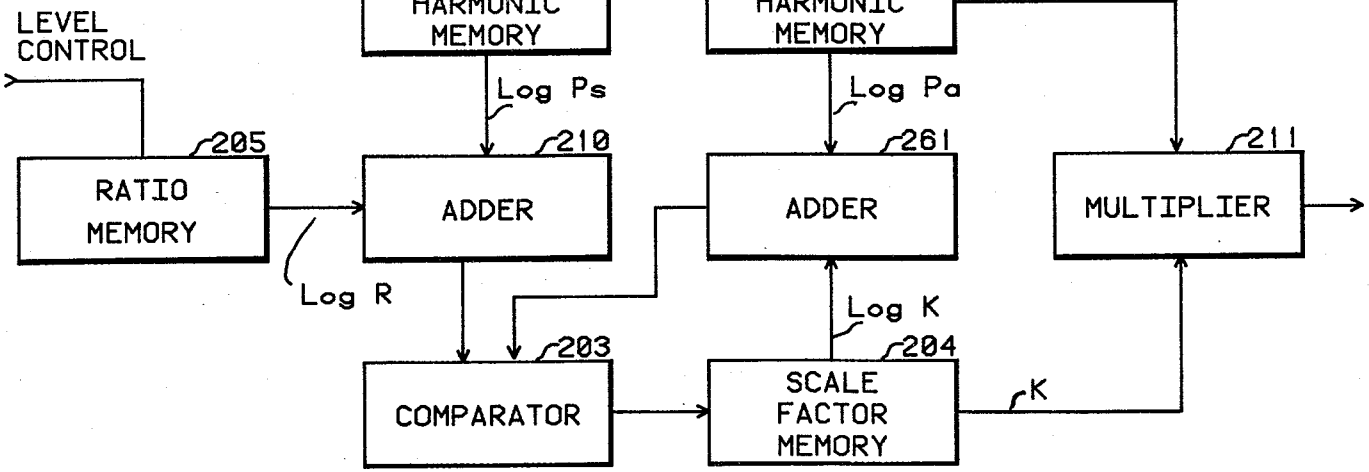
FIG. 2 is a schematic block diagram of an alternative embodiment of the invention.

FIG. 2 illustrates an alternative implementation for the basic system shown in FIG. 1. The alternative implementation employs logarithmic values of the system parameters so that adders can be used instead of the multipliers shown in FIG. 1. In the system shown in FIG. 2, the scale factor memory stores values of K and values of log K which are simultaneously accessed by a single memory accessing value provided by the comparator 203.

In the system shown in FIG. 2, the value of log $P_s$ is furnished from the solo harmonic memory 27 and the value log $P_a$ is furnished from the accompaniment harmonic memory 127. Similarly the ratio memory 205 now provides the logarithmic value log R in response to the level control signal.

Adder 210 furnishes the sum log R+log $P_s$ as one input to the comparator 203. This input value is compared with the value of log K+log $P_a$ furnished to comparator 203 by the adder 261.

The system shown in FIG. 2 appears to provide a simpler arrangement in comparison to the system shown in FIG. 1 because the use of the addition of logarithmic data is easier and more economical to implement than a multiplication of data as required in FIG. 1. A hidden difficulty lies in the need for obtaining a value of log $P_s$ and log $P_a$ for combinations of harmonic coefficient sets selected by means of the stop switches. One cannot simply store values of the component loudness parameters log $P_a$ and log $P_s$ because a summation of such logarithmic quantities does not produce the desired values of log $P_s$ and log $P_a$. The usual solution is to store the linear values $P_s$ and $P_a$ which are summed according to Eq. 2 and Eq. 3 to form $P_a$ and $P_s$. The values of $P_a$ and $P_s$ are then converted by known techniques to the desired logarithmic forms of log $P_a$ and log $P_s$.

Instead of storing the logarithmic values of log K, a logarithmic converter can be used to obtain log K from the values of K accessed out from the scale factor memory K.

The system shown in FIG. 1 provides a good balance compensation when the number of notes played on each keyboard remain approximately equal. Since it is not always possible to play with an equal number of notes on each keyboard at all times, a note compensation logic can be introduced as illustrated by the subsystem shown in FIG. 3. This system maintains a loudness balance between keyboards that is adaptive both to the stop switch combinations and the number of actuated notes on both keyboards.

The note detect and assignor 14 is provided with a subsystem, later described, which provides the values of $N_s$ and $N_a$. $N_s$ is the number of keyswitches currently actuated on the solo keyboard and $N_a$ is the number of keyswitches currently actuated on the accompaniment keyboard. The system shown in FIG. 3 operates adaptively to maintain the relation $$K N_a P_a = R N_s P_s \qquad \text{Eq. 5}$$

The ratio number R is selected from the ratio memory 205 in response to the level control signal.

Multiplier 215 provides the output product value $N_sP_s$ as one input to the multiplier 201. The multiplier 201 provides the product value of $RN_sP_s$ as one input to the comparator 203. The multiplier 216 provides the output product value $N_aP_a$ as one input to the multiplier 202. The multiplier 202 provides the value of $KN_aP_a$ to the comparator 203.

The comparator 203 operates as previously described for the system shown in FIG. 1 to address a scale factor K from the scale factor memory 204.

Figure 3:
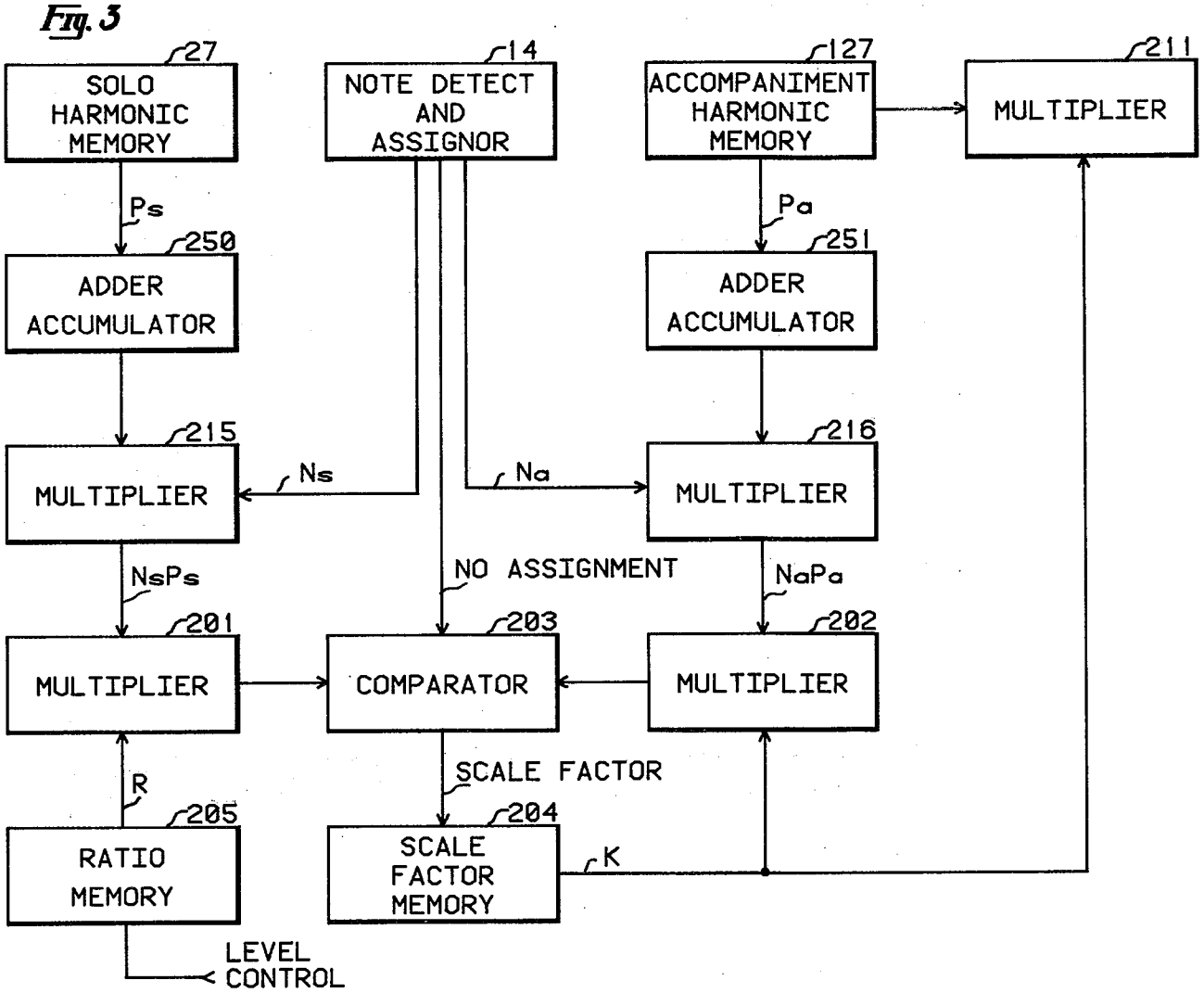
FIG. 3 is a schematic diagram of an alternative embodiment of the invention which is adaptive to the number of actuated keyboard notes.

The comparator 203 as shown in FIGS. 1, 2, and 3 operates to select a fixed value, such as $K=1$, from the scale factor memory 204 when no keyswitches have been actuated on the solo manual. The no assignment signal is generated if no keyswitches have been actuated on the upper keyboard as indicated by a value of $N_s=0$.

Figure 4:
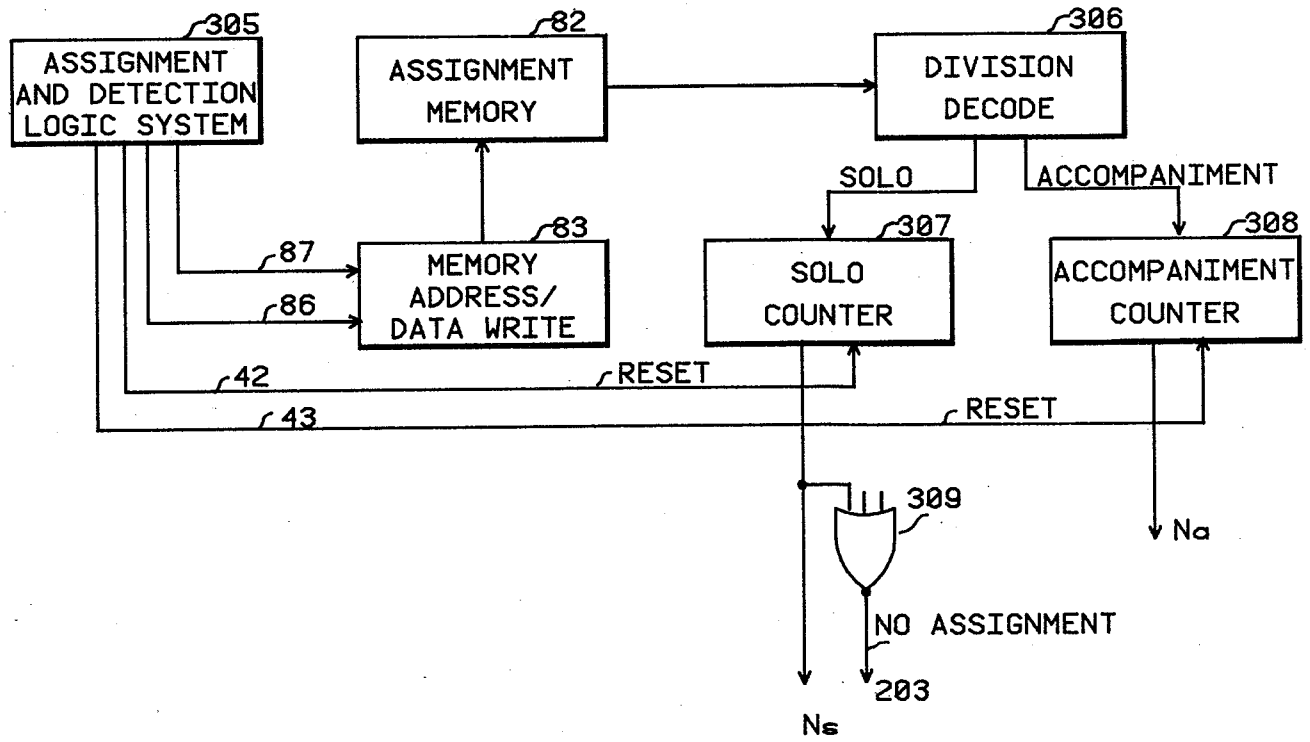
FIG. 4 is a schematic block diagram of a subsystem to count actuated keyswitches.

FIG. 4 illustrates the logic used to obtain the values of $N_a$ and $N_s$ for the number of actuated keyswitches on each keyboard. The two digit numbers correspond to the same numbered elements shown in the drawings of the previously referenced U.S. Pat. No. 4,022,098. Block 305 symbolically represents the logic described in the referenced patent for detecting actuated keyswitches and causing encoded identification data to be written into the assignment memory 82 by means of the memory address data write 83. The encoded data identifies an actuated keyswitch by division number (keyboard designation number), octave number, and note within an octave. The signal on line 42 appears when division 1, or the solo keyboard, is scanned. The signal on line 42 appears when division 2, or the accompaniment keyboard, is scanned.

As each stored word is sequentially read out of the assignment memory 82, the division decode 306 decodes the encoded keyboard division information. The decoded solo keyboard key actuated information is supplied to increment the solo counter 307 and the decoded accompaniment keyboard key actuated information is supplied to increment the accompaniment counter 308. The solo counter 307 is reset by the signal on line 42 at the start of a solo keyboard scan and the accompaniment counter 308 is reset by the signal on line 43 at the start of an accompaniment keyboard scan. At the end of a solo keyboard scan the count state of the solo counter 307 is the number $N_s$ and at the end of an accompaniment keyboard scan the count state of the accompaniment counter 308 is the number $N_a$.

The binary bits forming the binary word $N_s$ are used as an input to the NOR-gate 309. The output of this gate is a logic "1" if all the bits comprising the binary value of $N_s$ are "0". This logic "1" provides the NO ASSIGNMENT signal for the comparator 203.

Instead of storing the individual loudness values $p_s$ or $p_a$, these can be readily computed from the values of the corresponding harmonic coefficients. The alternative arrangement of computing the loudness values instead of using stored values is useful in systems such as described in the referenced U.S. Pat. No. 4,085,644 wherein the harmonic coefficients are modified in a time varying fashion.

Figure 5:
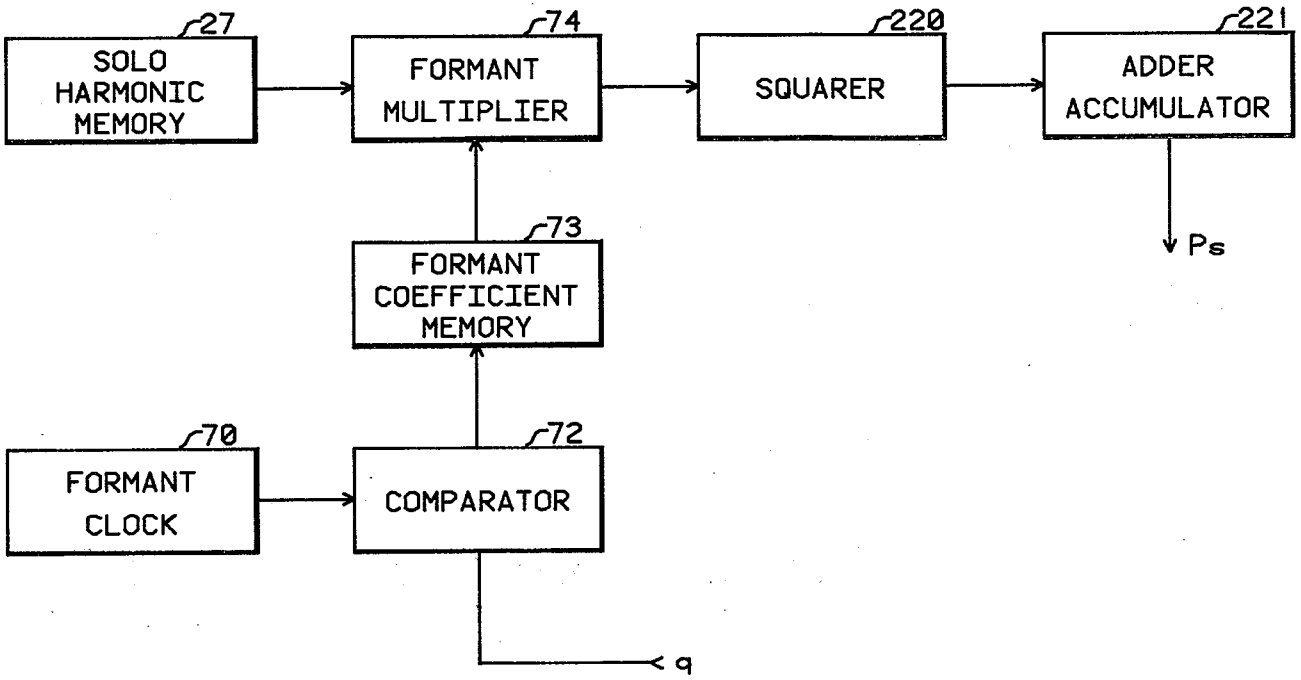
FIG. 5 is a schematic block diagram of a subsystem to compute loudness values.

FIG. 5 illustrates a system for computing the combined loudness factor $P_s$. The system elements having two digit numbers correspond to the same numbered elements described in the U.S. Pat. No. 4,085,644.

The harmonic coefficients $c_i$ read out of the solo harmonic memory 27 are multiplied by means of the formant multiplier 74 with the formant coefficients read out of the formant coefficient memory 73. The product values furnished by the formant multiplier 74 are multiplied by themselves, or squared, by means of the squarer 220. The squared values are called squared harmonic coefficients. The output values from the squarer 220 are successively added to the contents of an accumulator in the adder-accumulator 221 to provide the desired value of $P_s$.

It should be noted that the value of $P_s$ obtained as shown in FIG. 5 corresponds to one computed during a current computation cycle. Since this value is not available until the end of a computation cycle, it is expedient to use the value of $P_s$ obtained during the immediate prior computation cycle, in the repetitive sequence of computation cycles, for the adaptive loudness systems such as shown in FIGS. 1 and 3.

While the invention has been illustrated for the case of a balance between a solo keyboard and an accompaniment keyboard it is obvious that a pedal keyboard can be substituted for the accompaniment keyboard. It is also evident that the loudness balance system can be extended to maintain a preset loudness balance between a given keyboard, such as the solo keyboard, and any desired number of other keyboards by replicating the loudness value comparison arrangements previously described.

I claim:

1. In a musical instrument having a first and second keyboard each having an array of keyswitches and in which the successive points of a first and a second waveshape are computed by means of a discrete Fourier transform using sets of selected harmonic coefficients, apparatus for maintaining a loudness ratio between the musical tones generated in response to keyswitches actuated on the first keyboard and the musical tones generated in response to keyswitches actuated on the second keyboard in response to a preselected level control signal comprising:

a plurality of first harmonic memories each storing a data set comprising a set of harmonic coefficients and a loudness value, a plurality of second harmonic memories each storing a data set comprising a set of harmonic coefficients and a loudness value, memory addressing means for reading out data sets stored in said plurality of first harmonic memories and data sets stored in said plurality of second harmonic memories, a ratio number generator generating a ratio number R, a first plurality of tone switches associated with said first keyboard for selecting data sets read out of said plurality of first harmonic memories, a second plurality of tone switches associated with said second keyboard for selecting data sets read out of said plurality of second harmonic memories, loudness balance means whereby the data sets selected by said second plurality of tone switches are scaled in magnitude in response to said ratio number R to produce scaled data sets, a first computing means for computing a waveshape in response to data sets selected by said first plurality of tone switches, a second computing means for computing a waveshape in response to said scaled data sets, a plurality of first tone generators, each of which is associated with an actuated keyswitch on said first keyboard, for converting the waveshape computed by said first computing means to audible musical sounds, and a plurality of second tone generators, each of which is associated with an actuated keyswitch on said second keyboard, for converting the waveshape computed by said second computing means to audible musical sounds.

2. A musical instrument according to claim 1 wherein said loudness balance means comprises;

a first accumulator means for obtaining the sum $P_s$ of said loudness values from data sets selected by said first plurality of tone switches, a second accumulator means for obtaining the sum $P_a$ of said loudness from data sets selected by said second plurality of tone switches, a first multiplier means for multiplying the sum $P_s$ contained in said first accumulator means by said ratio number R to produce a first product number $RP_s$, a scale factor generator wherein a scale factor K is generated in response to a scale factor signal, a second multiplier means for multiplying the sum $P_a$ contained in said second accumulator means by said scale factor K to produce a second product number $KP_a$, and a comparison means responsive to said first product number $RP_s$ and to said second product number $KP_a$ wherein said scale factor signal is generated.

3. A musical instrument according to claim 2 wherein said comparison means comprises;

scale factor generation means whereby said scale factor signal is generated with a preselected default magnitude if no keyswitches have been actuated on said first keyboard, whereby said scale factor signal is generated with an increased magnitude if said second product number $KP_a$ is less than said first product number $RP_s$, whereby said scale factor signal is generated with a decreased magnitude if said second product number $KP_a$ is greater than said first product number $RP_s$, and whereby said scale factor signal is unaltered in magnitude if the difference in magnitude of said first product number $RP_s$ and said second product number $KP_a$ is less than some preselected difference number.

4. A musical instrument according to claim 3 wherein said scale factor generator means comprises;

scale factor circuitry whereby a scale factor K of unit magnitude is generated in response to a scale factor signal having said preselected default magnitude, and whereby the magnitude of the generated scale factor K is responsive to the magnitude of said scale factor signal.

5. A musical instrument according to claim 4 wherein said scale factor circuitry comprises an addressable memory storing values of said scale factor K which are read out in response to said scale factor signal.

6. A musical instrument according to claim 1 wherein said ratio number generator comprises an addressable memory storing values of said ratio number R which are read out in response to said level control signal.

7. A musical instrument according to claim 2 wherein said loudness balance means further comprises a third multiplier means wherein the magnitudes of the harmonic coefficients selected by said second plurality of tone switches are multiplied by said scale factor K.

8. In a musical instrument having a first and second keyboard each containing an array of keyswitches and in which the successive points of a first and a second waveshape are computed by means of a discrete Fourier transform using sets of selected harmonic coefficients, apparatus for maintaining a loudness ratio between the musical tones generated in response to the number of keyswitches actuated on the first keyboard and the musical tones generated in response to the number of keyswitches actuated on the second keyboard in response to a preselected level control signal comprising;

a first keyboard detector for determining the number $N_s$ of keyswitches actuated on said first keyboard, a second keyboard detector for determining the number $N_a$ of keyswitches actuated on said second keyboard, a plurality of first harmonic memories each storing a data set comprising a set of harmonic coefficients and a loudness value, a plurality of second harmonic memories each storing a data set comprising a set of harmonic coefficients and a loudness value, memory addressing means for reading out data sets stored in said plurality of first harmonic memories and data sets stored in said plurality of second harmonic memories, a ratio number generator generating a ratio number R, a first plurality of tone switches associated with said first keyboard for selecting data sets read out of said plurality of first harmonic memories, a second plurality of tone switches associated with said second keyboard for selecting data sets read out of said plurality of second harmonic memories, loudness balance means whereby the data sets selected by said second plurality of tone switches are scaled in magnitude in response to said ratio number R, said number of keyswitches $N_a$, and said number of keyswitches $N_a$ thereby producing scaled data sets, a first computing means for computing a waveshape in response to data sets selected by said first plurality of tone switches, a second computing means for computing a waveshape in response to said scaled data sets, a plurality of first tone generators each of which is associated with an actuated keyswitch on said first keyboard for converting the waveshape computed by said first computing means to audible musical sounds, and a plurality of second tone generators each of which is associated with an actuated keyswitch on said second keyboard for converting the waveshape computed by said second computing means to audible musical sounds.

9. A musical instrument according to claim 8 wherein said loudness balance means comprises;

a first accumulator means for obtaining the sum $P_s$ of said loudness values from data sets selected by said first plurality of tone switches, a second accumulator means for obtaining the sum $P_a$ of said loudness values from data sets selected by said second plurality of tone switches, a first multiplier means for multiplying the sum $P_s$ contained in said first accumulator means by said number $N_s$ to produce the first product number $N_sP_s$, a second multiplier means for multiplying said first product number $N_sP_s$ by said ratio number R to produce a second product number $RN_sP_s$, a third multiplier means for multiplying the sum $P_a$ contained in said second accumulator means by said number $N_a$ to produce a third product number $N_aP_a$, a scale factor generator wherein a scale factor K is generated in response to a scale factor signal, a fourth multiplier means for multiplying said third product number $N_aP_a$ by said scale factor K to produce a fourth product number $KN_aP_a$, and a comparison means responsive to said second product number $RN_aP_s$ and to said fourth product number $KN_aP_a$ wherein said scale factor signal is generated.

10. In a musical instrument having a first and a second keyboard each containing an array of keyswitches and in which the successive points of a first and a second waveshape are computed by means of a discrete Fourier transform using sets of selected harmonic coefficients, apparatus for maintaining a loudness ratio between the musical tones generated in response to keyswitches actuated on the first keyboard and the musical tones generated in response to keyswitches actuated on the second keyboard in response to a preselected level control signal comprising;

a plurality of first harmonic memories each storing a set of harmonic coefficients, a plurality of second harmonic memories each storing a set of harmonic coefficients, memory addressing means for reading out harmonic coefficients stored in said plurality of first harmonic memories and harmonic coefficients stored in said plurality of second harmonic memories, a ratio number generator generating a ratio number R, a first plurality of tone switches associated with said first keyboard for selecting harmonic coefficients read out of said plurality of first harmonic memories, a second plurality of tone switches associated with said second keyboard for selecting harmonic coefficients read out of said plurality of second harmonic memories, a loudness number generator wherein a loudness number $P_s$ is generated in response to harmonic coefficients selected by said first plurality of tone switches and wherein a loudness number $P_a$ is generated in response to harmonic coefficients selected by said second plurality of tone switches, loudness balance means responsive to said loudness numbers $P_s$ and $P_a$ whereby the harmonic coefficients selected by said second plurality of tone switches are scaled in magnitude in response to said number R to produce scaled data sets, a first computing means for computing a waveshape in response to harmonic coefficients selected by said first plurality of tone switches, a second computing means for computing a waveshape in response to said scaled data sets, a plurality of first tone generators each of which is associated with an actuated keyswitch on said first keyboard for converting the waveshape computed by said first computing means to audible sounds, and a plurality of second tone generators each of which is associated with an actuated keyswitch on said second keyboard for converting the waveshape computed by said second computing means to audible sounds.

11. A musical instrument according to claim 10 wherein said loudness number generator comprises;

a first squarer means whereby each of said harmonic coefficients selected by said first plurality of tone switches is squared in magnitude to produce a first set of squared harmonic coefficients, a second squarer means whereby each of said harmonic coefficients selected by said second plurality of tone switches is squared in magnitude to produce a second set of squared harmonic coefficients, a first adder means wherein said first set of squared harmonic coefficients are summed to produce said loudness number $P_s$, and a second adder means wherein said second set of squared harmonic coefficients are summed to produce said loudness number $P_a$.

* * * * *